US006374213B2

(12) United States Patent
Imai et al.

(10) Patent No.: US 6,374,213 B2
(45) Date of Patent: Apr. 16, 2002

(54) ADAPTIVE SPEECH RATE CONVERSION WITHOUT EXTENSION OF INPUT DATA DURATION, USING SPEECH INTERVAL DETECTION

(75) Inventors: Atsushi Imai; Nobumasa Seiyama; Tohru Takagi, all of Tokyo (JP)

(73) Assignee: Nippon Hoso Kyokai, Tokyo (JP)

( * ) Notice: Subject to any disclaimer, the term of this patent is extended or adjusted under 35 U.S.C. 154(b) by 0 days.

(21) Appl. No.: 09/781,634

(22) Filed: Feb. 12, 2001

Related U.S. Application Data

(62) Division of application No. 09/202,867, filed as application No. PCT/JP98/01984 on Apr. 30, 1998.

(30) Foreign Application Priority Data

Apr. 30, 1997 (JP) ..... 9-112822
Apr. 30, 1997 (JP) ..... 9-112961

(51) Int. Cl.[7] ..... G10L 11/02
(52) U.S. Cl. ..... 704/233; 704/215
(58) Field of Search ..... 704/215, 233

(56) References Cited

U.S. PATENT DOCUMENTS 4,672,669 A * 6/1987 DesBlache et al. ..... 704/237
4,696,039 A * 9/1987 Doddington ..... 704/215
4,897,832 A * 1/1990 Suzuki et al. ..... 370/287
6,272,459 B1 * 8/2001 Takahashi ..... 704/221

FOREIGN PATENT DOCUMENTS

JP P58-130395 8/1983
JP P61-272796 12/1986
JP H6-98398 4/1994 ..... H04R/25/00
JP 06-266380 * 9/1994 ..... G10L/11/02
JP H8-294199 11/1996 ..... H04R/25/00

OTHER PUBLICATIONS

D–695: Development of Time–Lag Adaptive voice Speed Control Technology, by Hiroshi Tanaka, et al. and Hypermedia Research Center, Sanyo Electric Co., Ltd. (1995, p. 301) and English translation (p. 1–3).

2–6–2: An Approach for Absorbing Extension in Time caused in Speech Speed Conversion (A Method of Absorbing Time Expansion on Voice Speed Conversion) by Ryou Ikezawa, et al. (NHK Science & Technical Research Laboratories) p. 331–332 and English translation (p. 1–4).

D–694: Real Time Absorption Method for Extension in time caused in Speech Speed Conversion (A Method of absorption of temporal discrepancy caused by speech rate conversion), Atsushi imai, et al. and NHK Science and Technical Research Laboratories, p. 300 and English translation (pp. 1–3).

* cited by examiner

*Primary Examiner*—Tālivaldis Ivars Šmits
(74) *Attorney, Agent, or Firm*—Olson & Hierl, Ltd.

(57) ABSTRACT

Frame power of an input signal is calculated to discriminate speech frame intervals from non-speech intervals, by thresholding current frame power using an adaptive speech-detection threshold based on the past maximum frame power value and the difference between past maximum and the minimum frame power values, adaptively updated using a predetermined number of frames prior to the current one.

4 Claims, 6 Drawing Sheets

SUCCEEDINGLY READ BLOCK
(1) FLOW OF TIME
To
(1)
(2)
(3)
(4)
(5)
(6)
(7)
(8)
(9)
(10)
Si
(A) BLOCK READ FROM THE BLOCK DATA MEMORY 5
r·Si-So
So
L
(4')
(8')
CONNECTION DATA OF THE BLOCK (4)
LATTER HALF OF DATA IN THE BLOCK (4)
CONNECTION DATA OF THE BLOCK (8)
LATTER HALF OF DATA IN THE BLOCK (8)
SUCCEEDINGLY CONNECTED BLOCK
(B) ORDER OF BLOCKS CONNECTED BY THE SPEECH DATA CONNECTOR 9

ADAPTIVE SPEECH RATE CONVERSION WITHOUT EXTENSION OF INPUT DATA DURATION, USING SPEECH INTERVAL DETECTION

RELATED APPLICATION

This application is a division of patent application Ser. No. 09/202,867 filed Dec. 22, 1998 in the name of Atsushi Imai et al., which is a 371 of PCT/JP98/01984 filed Apr. 30, 1998.

TECHNICAL FIELD

The present invention relates to a speech speed converting method and a device for embodying the same which are able to achieve easiness of hearing expected in speech speed conversion without extension of playback time in various video devices, audio devices, medical devices, etc. such as a television set, a radio, a tape recorder, a video tape recorder, a video disk player, a hearing aid, etc.

The present invention also relates to a speech interval detecting method and a device for embodying the same which are able to discriminate between speech intervals and non-speech intervals of an input signal in the event that the speech which is delivered together with noises or background sounds in a broadcast program, a recording tape, or a daily life is processed to change height of the voice or speech speed, the meaning of the speech is mechanically recognized, the speech is coded to transfer or record, or the like.

[Outline of the Invention]

The present invention relates to a speech speed converting method and a device for embodying the same which converts a speech speed in real time by processing the speech made by the human being, and carries out a series of processes without omission of information, while monitoring always a data length of the input speech, an output data length calculated previously according to a conversion function, which is concerned with a previously given scaling factor, and a data length of the speech being output actually in constant process unit when a delivered speed (speech speed) of listening speech is made slow.

Furthermore, in the speech speed converting method and the device for embodying the same, for example, the non-speech interval which has a length in excess of a variable threshold value being set according to a delay degree (conversion factor) expected in speech speed conversion can be reduced appropriately while aiming at minimizing the time difference between the image and the speech caused by extension of the speech in watching the television receiver, and maximum slowness impression which can be accomplished within a decided time range can be created automatically by changing adaptively a conversion factor according to a degree of time difference between the input data length and the output data length, while keeping substantially a speaking time of the converted speech within a speaking time of an original speech.

Moreover, the present invention calculates the power of input signal data at a predetermined time interval in frame unit having a predetermined time width, and then discriminates between the speech interval and the non-speech interval every frame by using the threshold value for the power which is changed according to the maximum value and the difference between the maximum value and the minimum value, while holding the maximum value and the minimum value of the power within the past predetermined time period, so as to respond sequentially to change in respective powers of the input speech and the background sound. As a result improvement in quality of processed sound, improvement in the speech recognition rate, increase in the coding efficiency, and improvement in quality of the decoded speech can be achieved by detecting precisely the speech interval of the input signal in the case that changed in height of the voice or speech speed, mechanical recognition of the meaning of the speech, and coding of the speech to transfer or record, and the like are effected by processing the speech which is delivered together with noises or background sounds in a broadcast program, a recording tape, or a daily life.

In addition, the speech processing can be executed in real time while shortening a calculation time and also reducing a cost, by employing only the power which can be derived relatively simply as a feature parameter.

BACKGROUND ART

In case the speech speed converting method is applied to the actual broadcast, there are some cases where delay from the original speech such as emergency news becomes an issue. Particularly, it is possible that this delay has a bad effect on the visual media in contrast with the effect expected in the speech speed conversion.

Therefore, as approaches for achieving the speech speed converting effect (slowness impression) without delay from the original speech, there have been reported the method of suppressing extension in time by changing the speech speed from slowly to quickly as a function of a lapse time from a start point of one breath speech to an end point instead of uniformly slow conversion, and then reducing appropriately the non-speech interval between sentences (R. Ikezawa et al., "An Approach for Absorbing Extension in Time Caused in Speech Speed Conversion", Spring Conference, Japanese Acoustic Society, 2-6-2, pp.331–332, 1992), the method of achieving this approach in real time (A. Imai et al., "Real Time Absorption Method for Extension in Time Caused in Speech Speed Conversion", in International Conference, IEICE, D-694, pp 300, 1995), etc.

The former sets an appropriate function manually under that assumption that all speech styles have been known. The latter also sets a function defining a factor manually, and fixes this function after the function has been set once.

In addition, only the constant remaining time is set manually to reduce the non-speech interval. If a deal of "inconsistency" is integrated, the extended speech being accumulated in a buffer is cleared manually.

Therefore, in the speech speed converting device in the prior art, there has been such a problem that, since various speaking styles (speech speed, "timing" in speech, etc.) are present in the broadcast speech according to the speaker and also appropriate parameters must be set manually respectively, the device has many operation points, setting per se is difficult, and it is difficult for the common user to handle the device.

Besides, in the above speech speed converting device, the speech interval and the non-speech interval must be recognized separately. There are various systems as the speech interval detecting system in the prior art.

As one of the speech interval detecting system in the prior art, such a system has been known that a noise level and a speech level are calculated based on the power of the speech signal, etc., then a level threshold value is set based on the calculation result, then this level threshold value and the input signal are compared with each other, then the interval is decided as the speech interval if the level of the input signal is higher than the level threshold value and the interval is decided as the non-speech interval if the level of the input signal is lower than the level threshold value.

As methods of setting the level threshold value employed in this system, there are first to third representative systems. According to the first system, a value which is obtained by adding a preselected constant to a noise level value of the input speech is employed as the level threshold value. According to the second system which is an improved first system, the level threshold value is set to a relatively large value when a value obtained by subtracting the noise level value from a maximum level value of the input speech signal is large, whereas the level threshold value is set to a relatively small value when the value obtained by subtracting the noise level value from a maximum level value of the input speech signal is small (for example, Patent Application Publication (KOKAI) Sho 58-130395, Patent Application Publication (KOKAI) Sho 61-272796, etc.).

According to the third system, in addition to these level threshold value setting methods, the input signal is monitored continuously, then the input signal is regarded as the noise level when the level of the input signal is steady over a constant time period, and then a threshold value employed for the speech interval detection is set while updating the noise level sequentially (Proceeding in International Conference, IEICE, D-695, pp 301, 1995).

However, in the above speech interval detecting system in the prior art, there have been problems described in the following.

To begin with, the first system has an advantage that it is simple, and can operate well when the average level of the speech is a middle level. However, the first system is easy to detect the noise, etc. erroneously as speech when the average level of the speech is too large, and it is easy to detect the speech with omission of a part of the speech when the average level of the speech is too small.

Then, the second system can overcome the problem arisen in the first system. However, there has been such a problem that, since the event that levels of the noises and the background sounds in the input signal are kept substantially constant is employed as a premise, the second system can follow the variation in level of the speech, but the precise speech interval detection cannot be assured when levels of the noises and the background sounds are changed at every moment.

Then, since the variation in such noise level is considered into the third system, erroneous detection is not caused even when the noise level is changed sequentially.

However, not only the noise but also the background sound such as music, imitation sound, etc. as sound effects are included in the broadcast program, etc., and commonly these levels are changed at every moment and at the same time the speech is always continued to deliver, so that the input signal level seldom becomes steady over a predetermined time period. In such case, there has been such a problem that, since the noise level cannot be set correctly even by the third system, it is difficult to detect precisely the speech interval.

The present invention has been made in view of the above circumstances, and it is an object of the present invention to provide a speech speed converting method and a device for embodying the same which is capable of controlling adaptively the speech speed conversion factor and the non-speech interval according to set conditions only by setting the conversion factor employed as the several-stage aims once by the user, and also achieving the expected effect for the speech speed conversion stably within the time range which is delivered actually.

Also, it is another object of the present invention to provide a speech interval detecting method and a device for embodying the same which is capable of discriminating the speech interval and the non-speech interval by executing the speech processing in real time so as to respond sequentially to change in the respective levels of the input speech and the background sound, while shortening the calculation time and also reducing the cost, since only the power which can be derived relatively simply as a feature parameter is employed.

DISCLOSURE OF THE INVENTION

In order to achieve the above object, there is provided a speech interval detecting method set forth in claim 1 comprising the steps of calculating a frame power of an input signal data in unit of predetermined frame width at a predetermined time interval, and then holding a maximum value and a minimum value of the frame power within a past predetermined time period; deciding a threshold value for power changed according to the maximum value being held and difference between the maximum value and the minimum value; and comparing the threshold value with power of a current frame to decide whether or not the current frame belongs to a speech interval or a non-speech interval.

According to the above configuration, in the speech interval detecting method aspect of the invention, a frame power of an input signal data is calculated in unit of predetermined frame width at a predetermined time interval, then a maximum value and a minimum value of the frame power within a past predetermined time period are held, then a threshold value for power is decided according to the maximum value being held and difference between the maximum value and the minimum value, and then the threshold value and power of a current frame are compared with each other to decide whether or not the current frame belongs to a speech interval or a non-speech interval. Therefore, the speech interval and the non-speech interval can be discriminated by executing the speech processing in real time while responding sequentially to change in respective levels of the input speech and the background sound.

According to the speech interval detecting method set forth in the preceding paragraph, if the difference between the maximum value and the minimum value is less than a predetermined value, the threshold value is decided close to the maximum value rather than a case where the difference between the maximum value and the minimum value is more than the predetermined value.

In order to achieve the above object, there is provided a speech interval detecting device as in the preceding paragraph including a power calculator for calculating a frame power of an input signal data in unit of predetermined frame width at a predetermined time interval; an instantaneous power maximum value latch for holding a maximum value of the frame power within a past predetermined time period; an instantaneous power minimum value latch for holding a minimum value of the frame power within the past predetermined time period; a power threshold value decision portion for deciding a threshold value for power changed according to the maximum value being held in the instantaneous power maximum value latch and difference between the maximum value and the minimum value being held in the instantaneous power minimum value latch; and a discriminator for comparing the threshold value obtained by the power threshold value decision portion with power of a current frame to decide whether or not the current frame belongs to a speech interval or a non-speech interval.

According to the above configuration, in the speech interval detecting device set forth in the preceding paragraph, a power calculator calculates a frame power of an input signal data in unit of predetermined frame width at a predetermined time interval, an instantaneous power maximum value latch holds a maximum value of the frame power within a past predetermined time period, an instantaneous power minimum value latch holds a minimum value of the frame power within the past predetermined time period, a power threshold value decision portion decides a threshold value for power changed according to the maximum value being held in the instantaneous power maximum value latch and difference between the maximum value and the minimum value being held in the instantaneous power minimum value latch, and a discriminator compares the threshold value obtained by the power threshold value decision portion with power of a current frame to decide whether or not the current frame belongs to a speech interval or a non-speech interval. Therefore, while shortening a calculation time and also reducing a cost by employing only the power which can be derived relatively simply as a feature parameter, the speech interval and the non-speech interval can be discriminated by executing the speech processing in real time so as to respond sequentially to change in the respective levels of the input speech and the background sound.

According to the speech interval detecting device set forth the preceding paragraph, if the difference between the maximum value and the minimum value is less than a predetermined value, the power threshold value decision portion decides the threshold value close to the maximum value rather than a case where the difference between the maximum value and the minimum value is more than the predetermined value.

BEST MODE FOR CARRYING OUT THE INVENTION

The present invention will be explained in detail with reference to the accompanying drawings hereinafter.

Figure 1:
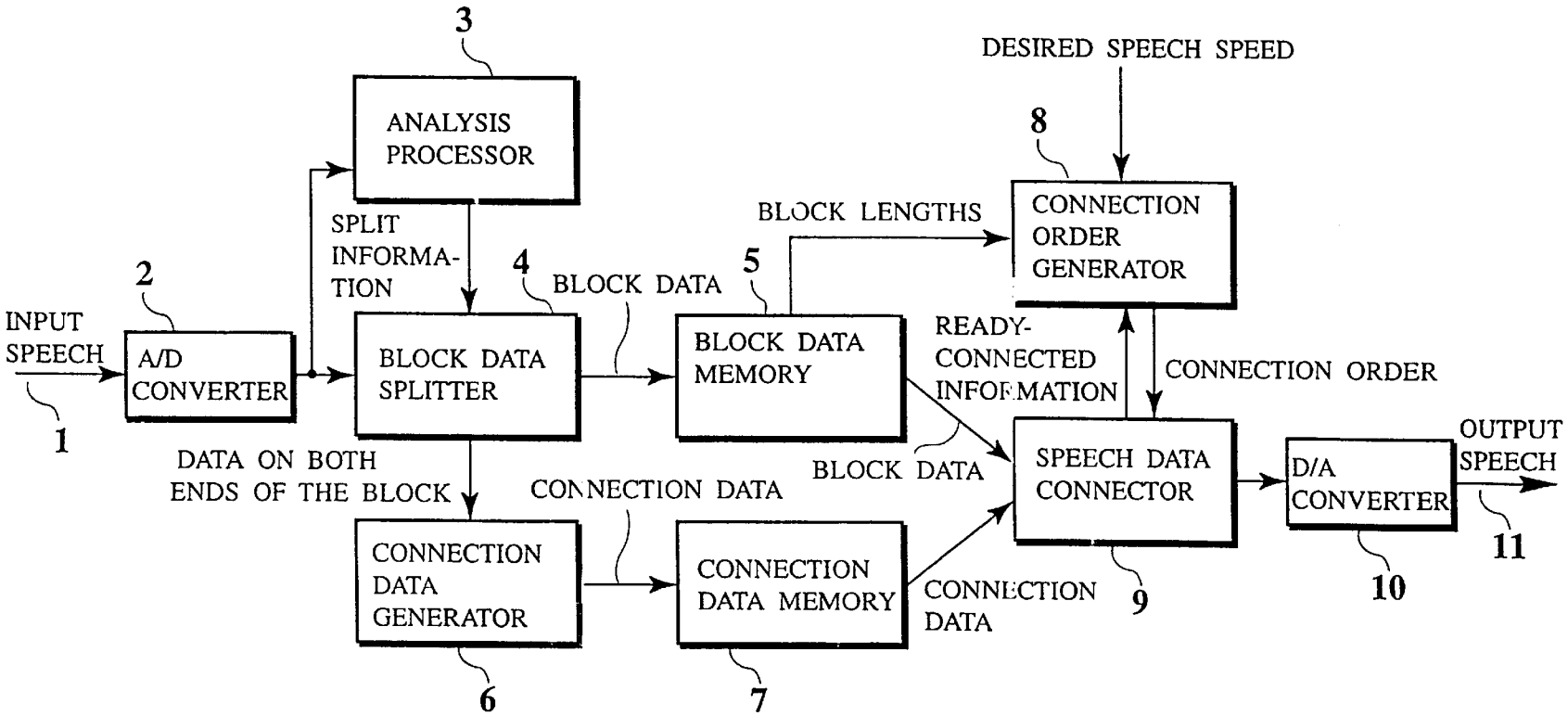
FIG. 1 is a block diagram showing a speech speed converting device according to an embodiment of the present invention.

FIG. 1 is a block diagram showing a speech speed converting device according to an embodiment of the present invention.

The speech speed converting device shown in FIG. 1 comprises a terminal 1, an A/D converter 2, an analysis processor 3, a block data splitter 4, a block data memory 5, a connection data generator 6, a connection data memory 7, a connection order generator 8, a speech data connector 9, a D/A converter 10, and a terminal 11. When the speech-speed converted speech data are synthesized by applying an analyzing process to input speech data from a speaker based on attributes of the speech data and then using a desired function according to the analyzed information, the speech speed converting device can eliminate omission of the speech information against change in scaling factor by executing these processes without inconsistency while comparing a data length (input data length) of input speech data, a target data length calculated by multiplying such data length by any scaling factor, and a data length (output data length) of actual output speech data, and can monitor time difference between the original speech being changed at every moment and the converted speech. And, the speech speed converting device can eliminate adaptively the time difference from the original speech because of the speech speed conversion by changing the scaling factor adaptively, e.g., by increasing the speech speed conversion factor temporarily when the time difference is small and conversely decreasing the speech speed conversion factor temporarily when the time difference is large, and further changing a remaining rate of the non-speech interval adaptively based on the speech speed conversion factor, an amount of expansion, etc.

The A/D converter 2 executes an A/D conversion of the speech signal being input into the terminal 1, e.g., the speech signal being output from an analog speech output terminal of the video device, the audio device, etc. such as the microphone, the television set, the radio, and others, at a predetermined sampling rate (e.g., 32 kHz), and supplies the resultant speech data to the analysis processor 3 and the block data splitter 4 neither too much nor too less while buffering such speech data into a FIFO memory.

The analysis processor 3 extracts the speech intervals and the non-speech intervals by analyzing the speech data being output from the A/D converter 2, then generates split information to determine respective time lengths necessary for the split process of the speech data being executed in the block data splitter 4 based on these intervals, and then supplies such split information to the block data splitter 4.

Now, embodiments of the speech interval detecting method and the device for embodying the same according to the present invention will be explained hereunder.

In the speech interval detecting method and the device for embodying the same according to the present invention, in view of the fact that level variation in the speech in the input signal is reflected on a maximum value of the power being input immediately before and level variation in the background sound is reflected on a minimum value of the power being input immediately before if power of the input signal is employed as an index, a threshold value can be decided by such a process that a value obtained by subtracting a predetermined value from the maximum value of power being input immediately before is set to a basic threshold value and then correction is applied to increase the basic threshold value as a value obtained by subtracting the minimum value from the maximum value of power being input immediately before is decreased (as an S/N is reduced), when noises are seldom present to determine a threshold value for speech/non-speech discrimination.

Then, the speech interval detecting method and the device for embodying the same calculates the power of the input speech data at a predetermined time interval in unit of frame having a predetermined time width, and then discriminates between the speech interval and the non-speech interval every frame by using the threshold value for the power which is changed according to the maximum value and difference between the maximum value and the minimum value, while responding sequentially to change in respective powers of the input speech and the background sound to hold the maximum value and the minimum value of the power in the past predetermined time interval.

The explanation will be made concretely with reference to the drawings hereinafter.

Figure 2:
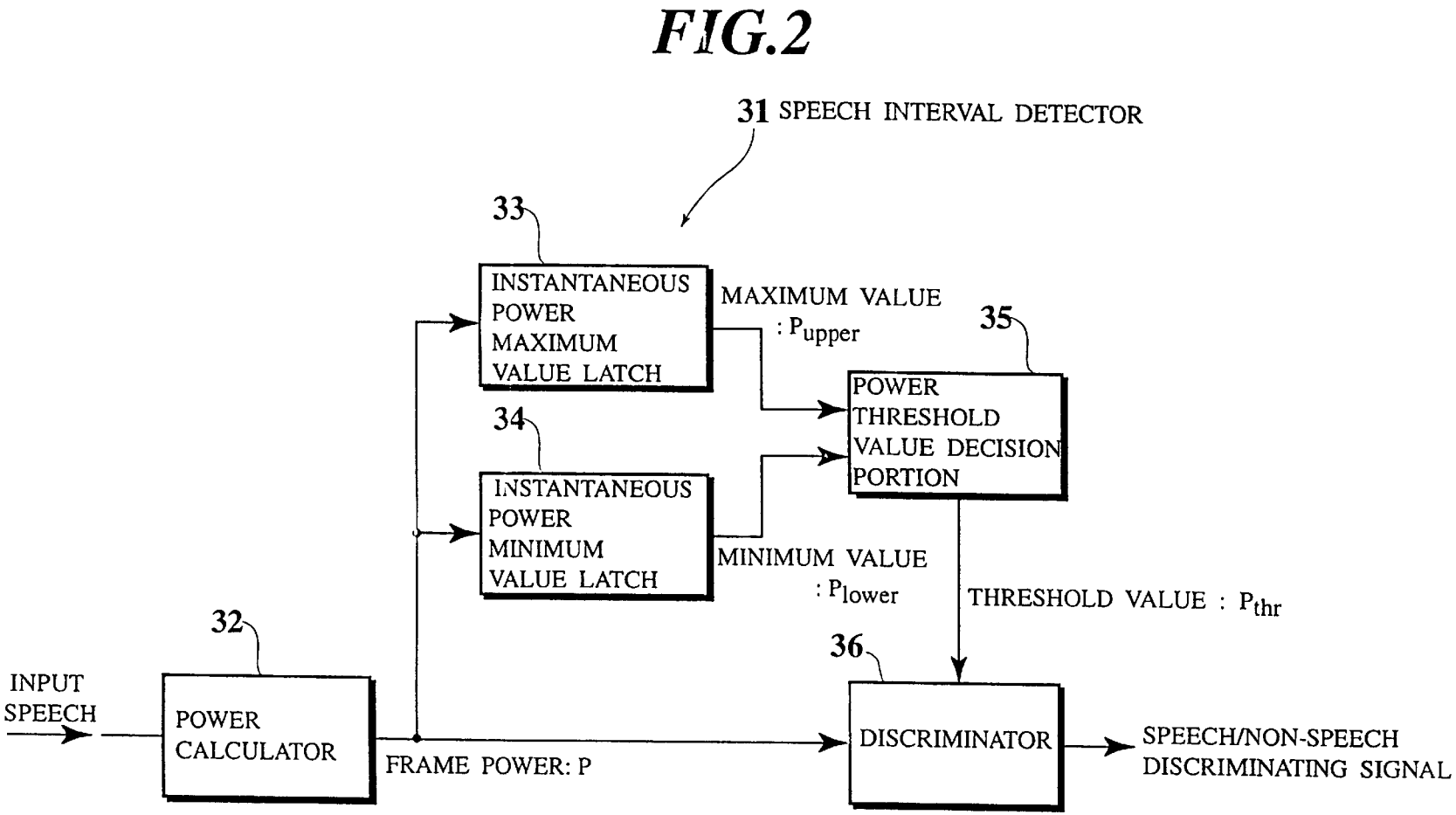
FIG. 2 is a block diagram showing a speech interval detecting device according to an embodiment of the present invention.

FIG. 2 is a block diagram showing the speech interval detecting device.

An speech interval detector 31 shown in FIG. 2 comprises a power calculator 32 for calculating the power of the digitized input signal data at a predetermined time interval by a predetermined frame width, an instantaneous power maximum value latch 33 for holding the maximum value of the frame power within the past predetermined time period, an instantaneous power minimum value latch 34 for holding the minimum value of the frame power within the past predetermined time period, a power threshold value decision portion 35 for deciding a threshold value for power which is changed according to both the maximum value and the difference between the maximum value held in the instantaneous power maximum value latch 33 and the minimum value held in the instantaneous power minimum value latch 34, and a discriminator 36 for discriminating whether or not the speech belongs to the speech interval or the non-speech interval, by comparing the threshold value decided by the power threshold value decision portion 35 with the power at the current frame.

The speech interval detector 31 calculates the power with respect to the input signal data at a predetermined time interval in frame unit having a predetermined time width, and then discriminates between the speech interval and the non-speech interval every frame by using the threshold value for power which is changed according to the maximum value and the difference between the maximum value and the minimum value, while responding sequentially to change in respective powers of the input speech and the background sound to hold the maximum value and the minimum value of the power within the past predetermined time period.

The power calculator 32 calculates a sum of squares or square mean value of the signal at a time interval of 5 ms over a frame width of 20 msec, for example, then sets the frame power at that time to "P" by representing this value logarithmically, i.e., in decibel, and then supplies this frame power "P" to the instantaneous power maximum value latch 33, the instantaneous power minimum value latch 34, and the discriminator 36.

The instantaneous power maximum value latch 33 is designed to hold the maximum value of the frame power "P" within the past predetermined time period (e.g., 6 seconds), and always supplies the held value "$P_{upper}$" to the power threshold value decision portion 35. However, when the frame power "P" to satisfy "$P>P_{upper}$" is supplied from the power calculator 32, the maximum value "$P_{upper}$" is immediately updated.

The instantaneous power minimum value latch 34 is designed to hold the minimum value of the frame power "P" within the past predetermined time period (e.g., 4 seconds), and always supplies the held value "$P_{lower}$" to the power threshold value decision portion 35. However, when the frame power "P" to satisfy "$P<P_{lower}$" is supplied from the power calculator 32, the minimum value "$P_{lower}$" is immediately updated.

The power threshold value decision portion 35 decides a threshold value "$P_{thr}$" of the power by executing calculations given in following equations, for example, with the use of the maximum value "$P_{upper}$" held in the instantaneous power maximum value latch 33 and the minimum value "$P_{lower}$" held in the instantaneous power minimum value latch 34, and then supplies the threshold value "$P_{thr}$" to the discriminator 36.

For $P_{upper}-P_{lower}\geqq 60$ [dB], $$P_{thr}=P_{upper}-35 \tag{1}$$

For $P_{upper}-P_{lower}<60$ [dB], $$P_{thr}=P_{upper}-35+35\times\{1-(P_{upper}-P_{lower})/60\} \tag{2}$$

In this case, it is desired that an upper limit of $P_{thr}$ should be set to $P_{thr}=P_{upper}-13$ in order to prevent the malfunction of the device of the present invention when a level of the background sound becomes close to a level of the speech. Also, a constant 35 in above Eqs. corresponds to a basic threshold value when the above mentioned noises are seldom present.

The discriminator 36 compares the power "P" supplied from the power calculator 32 every frame with the threshold value "$P_{thr}$" supplied from the power threshold value decision portion 35, then decides every frame that the frame belongs to the speech interval when "$P>P_{thr}$" is satisfied and that the frame belongs to the non-speech interval when "$P\leqq P_{thr}$" is satisfied, and then outputs a speech/non-speech discriminating signal based on these decision results.

Figure 3:
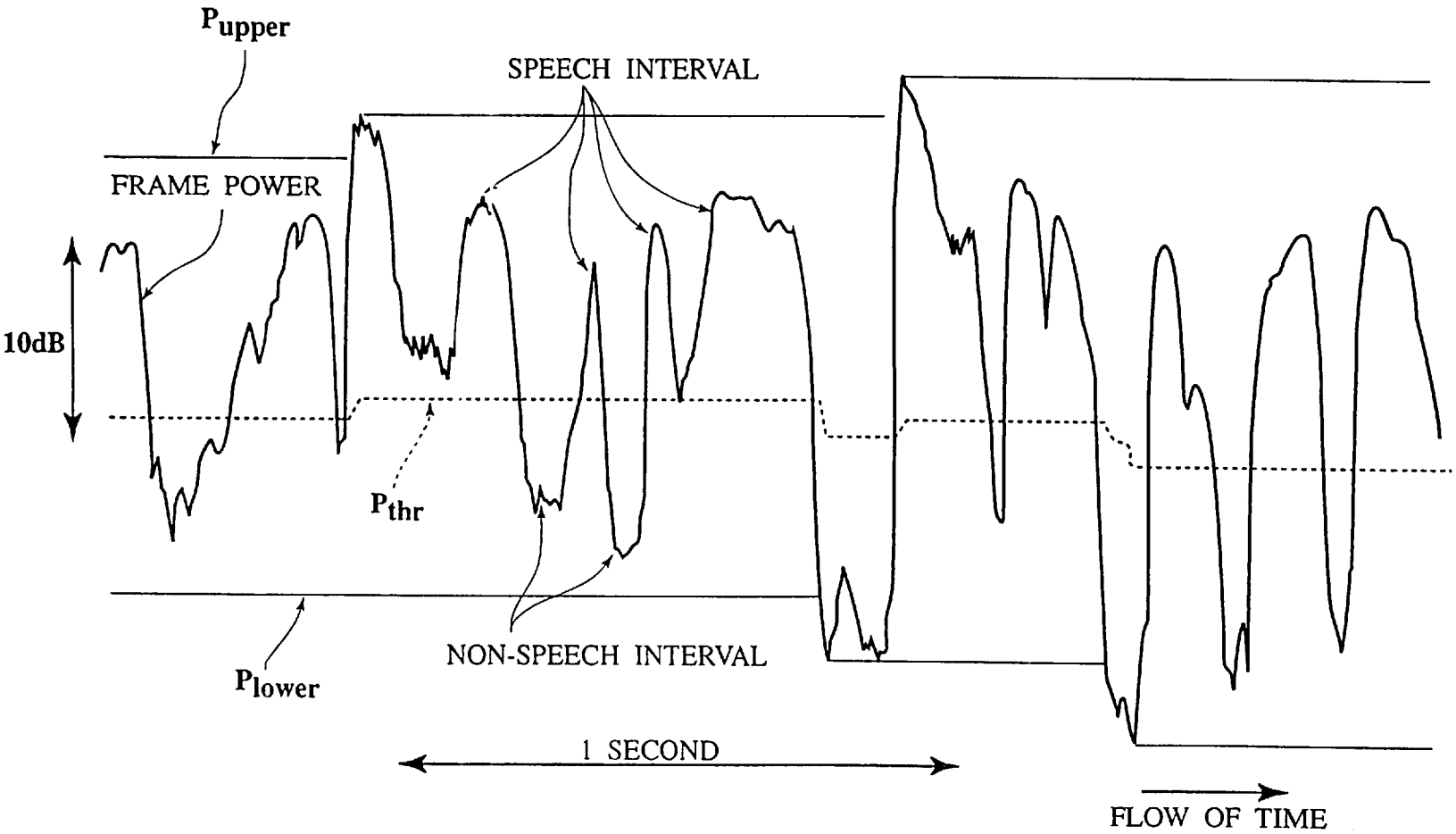
FIG. 3 is a schematic view showing an example of an operation of the speech interval detecting device shown in FIG. 2.

Accordingly, as shown in FIG. 3, under the situation that the value of the input signal data is being changed, the maximum value "$P_{upper}$" and the minimum value "$P_{lower}$" can be latched from the power "P" being output from the power calculator 32 by the instantaneous power maximum value latch 33 and the instantaneous power minimum value latch 34 respectively, then the threshold value "$P_{thr}$" is decided based on the maximum value "$P_{upper}$" and the minimum value "$P_{lower}$", and then it is decided based on this threshold value "$P_{thr}$" whether or not the frames belong to the speech interval or the non-speech interval respectively.

In this manner, in this embodiment, the power of the input signal data is calculated at a predetermined time interval in unit of frame having a predetermined time width and then, with responding sequentially to the change in the powers of the input speech and the background sound to keep the maximum value and the minimum value of the power within the past predetermined time period, the speech interval and the non-speech interval are discriminated by using the threshold value for power which changes according to the maximum value and the difference between the maximum value and the minimum value. Therefore, with regard to the speech which is delivered together with noises or background sounds in a broadcast program, a recording tape, or a daily life, the speech interval and the non-speech interval can be precisely discriminated frame by frame.

In this embodiment, since a level of the background sound is estimated based on the minimum value of the instantaneous power within the past predetermined time period, the speech interval and the non-speech interval of the input signal can be discriminated even if the level of the background sound is varied at every moment in the broadcast program, etc. and simultaneously the speech is continued to deliver.

As a result, in the case that (a) height of the voice and speed of the speech in the input signal are changed by processing the speech, (b) the meaning of the speech in the input signal is mechanically recognized, (c) the speech in the input signal is coded to transfer or record, etc., improvement in quality of processed sound, improvement in the speech recognition rate, increase in the coding efficiency, and improvement in quality of the decoded speech can be achieved.

Since only the power which can be derived relatively simply as a feature parameter is employed, a calculation time can be shortened and also a configuration of the overall device can be simplified to reduce a cost. In addition, speech processing can be executed in real time.

Next, in the speech speed converting method of the present invention, processes will be continued further as follows.

That is, the decision whether or not the speech is voiced sound with vibration of the vocal cords or voiceless sound without vibration of the vocal cords is applied to the interval in which the power exceeds the predetermined threshold value $P_{thr}$, i.e., the speech interval. Not only the magnitude of the power but also zero crossing analysis, autocorrelation analysis, etc. can be applied to this decision.

When a time length of the block is decided to analyze the speech data, periodicity is detected by applying the predetermined autocorrelation analysis to the speech interval (voiced sound interval, voiceless sound interval) and the non-speech interval, and then the block lengths are decided based on this periodicity. Then, pitch periods which are vibration periods of the vocal cords are detected from the voiced sound interval, and then the voiced sound interval is split such that respective pitch periods correspond to respective block lengths. At that time, since the pitch periods of the voiced sound interval is distributed over the wide range of about 1.25 ms to 28.0 ms, as precise pitch periods as possible are detected by executing the autocorrelation analysis using different window widths, or the like. The reason why the pitch period is used as the block length of the voiced sound interval is to prevent change in height of the voice due to repetition in block unit. As with the voiceless sound interval and non-speech interval, the block length is detected by detecting the periodicity within 5 ms.

Then, the block data splitter 4 splits the speech data output from the A/D converter 2 in accordance with the block length decided by the analysis processor 3, and then supplies the speech data which are obtained by this split process in unit of block and the block length to the block data memory 5. The block data splitter 4 also supplies both end portions of the speech data obtained by the split process in unit of block, i.e., a predetermined time length (e.g., 2 ms) after a start portion and a predetermined time length (e.g., 2 ms) before an end portion, to the connection data generator 6.

The block data memory 5 stores the speech data supplied in unit of block from the block data splitter 4 and the block length temporarily by virtue of ring buffer. The block data memory 5, as the case may be, supplies the speech data being stored temporarily in unit of block to the speech data connector 9 and supplies the block lengths being stored temporarily to the connection order generator 8.

Figure 4:
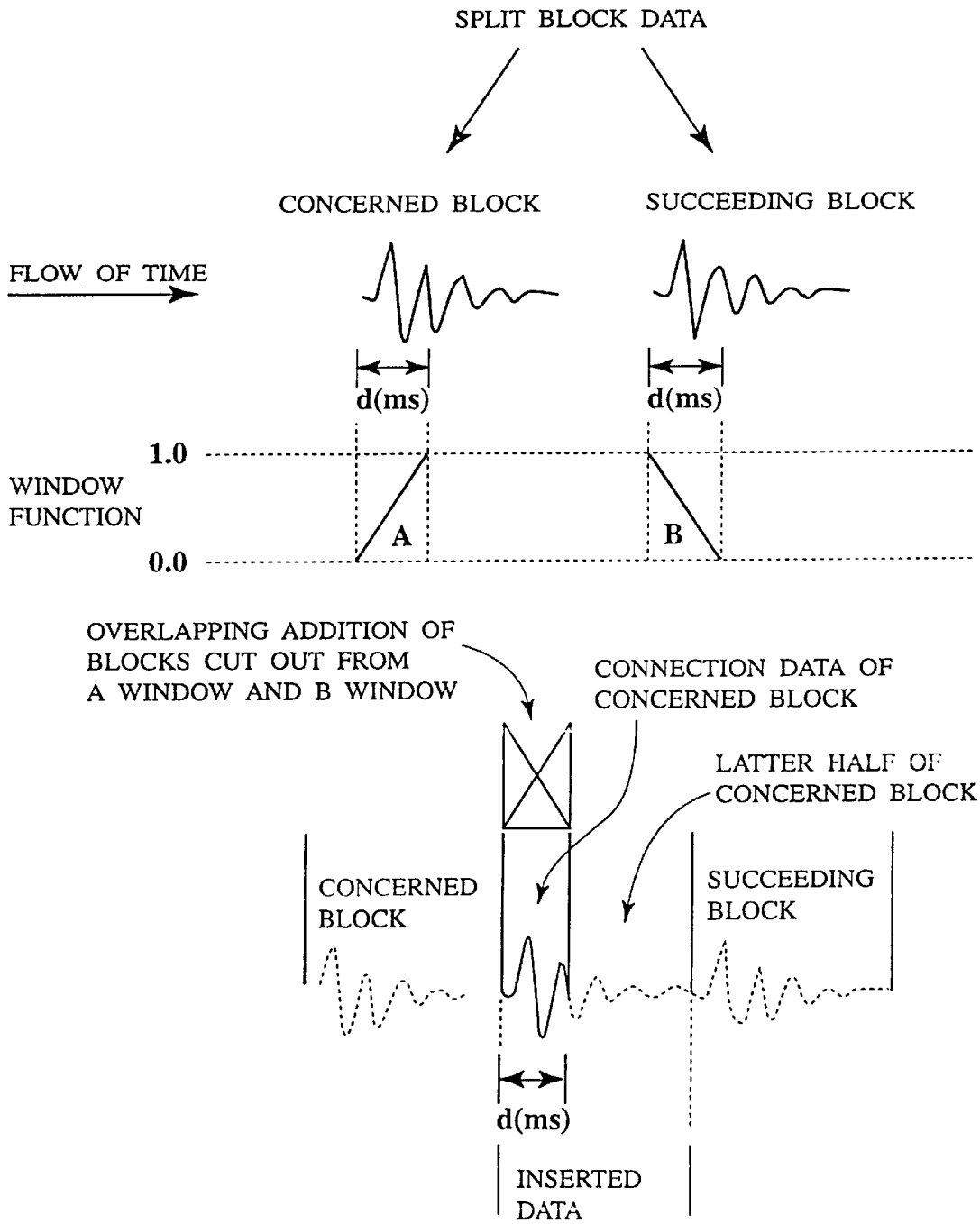
FIG. 4 is a schematic view showing a method of generating connection data, which is employed to connect the same block repeatedly in a connection data generator shown in FIG. 1.

The connection data generator 6 applies windows to the speech data in the end portion of the preceding block, the start portion of the concerned block, and the start portion of the succeeding block every block, as shown in FIG. 4, then executes overlapping addition of the end portion of the preceding block and the end portion of the concerned block and overlapping addition of the start portion of the concerned block and the start portion of the succeeding block, then generates connection data for every block by connecting them, and then supplies the connection data to the connection data memory 7.

The connection data memory 7 stores the connection data of respective blocks supplied from the connection data generator 6 temporarily by virtue of ring buffer, and then supplies the connection data being stored temporarily to the speech data connector 9 if necessary.

The connection order generator 8 generates the connection order of the speech data in unit of block and connection data in order to attain the desired speech speed which is set by a listener. In this case, the listener can set an extension factor in time for respective attributes (voiced sound interval, voiceless sound interval, and non-speech interval) by using a digital volume as an interface. This value is stored in a writable memory. Also, this value can be provided by selecting one of the method (uniform extension mode) in which such value is processed as a fixed extension factor and the method (time extension absorption mode) in which a speech speed converting effect can be achieved within a limited time range by controlling respective speech attributes totally and adaptively while aiming at such set factor, not to integrate the inconsistency for a predetermined time.

According to the connection order generator 8, when the speech synthesis is performed actually by using the extension factor being set in the memory, time difference between a delivered time of the original speech and an output time of the converted speech can be always monitored by grasping, in real time, time relationships among the input speech data length and the output speech data length at the same time and the speech data length to be synthesized, so that the time difference can be suppressed automatically within a constant length by feeding back this information. At the same time, it can be checked whether or not inconsistency in time (e.g., request such that the output speech data length must be set shorter than the input speech data length) is caused by using a scaling factor being changed into any value at any timing, and therefore omission of speech information in synthesis can be prevented.

Next, the process in the connection order generator 8 will be explained in detail hereunder. When the scaling factor of the speech is set by any function, the speech data length (=input data length) in processing unit specified by the block data splitter 4 is sequentially calculated based on respective block lengths supplied from the block data memory 5, and then a length which is derived by multiplying the input data length by the scaling factor being set by the listener is set as a target data length. The speech data connector 9 connects the speech data to coincide with this target data length, and also feeds back the speech data length (=output data length), which is a length of the output speech data being output actually, sequentially to the connection order generator 8.

Figure 5:
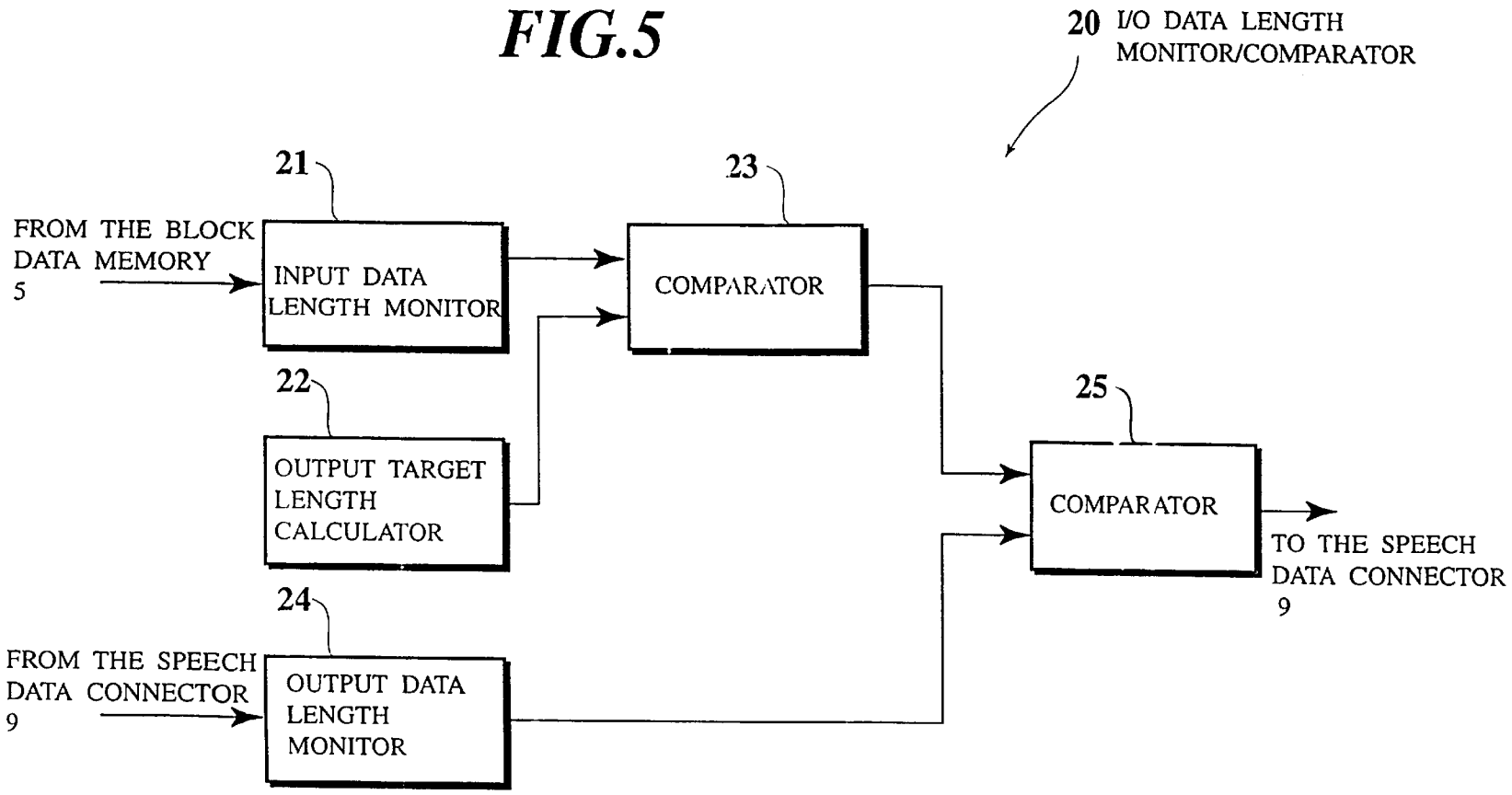
FIG. 5 is a block diagram showing an example of a detailed configuration of an I/O data length monitor/comparator in a connection order generator shown in FIG. 1.
Figure 6:
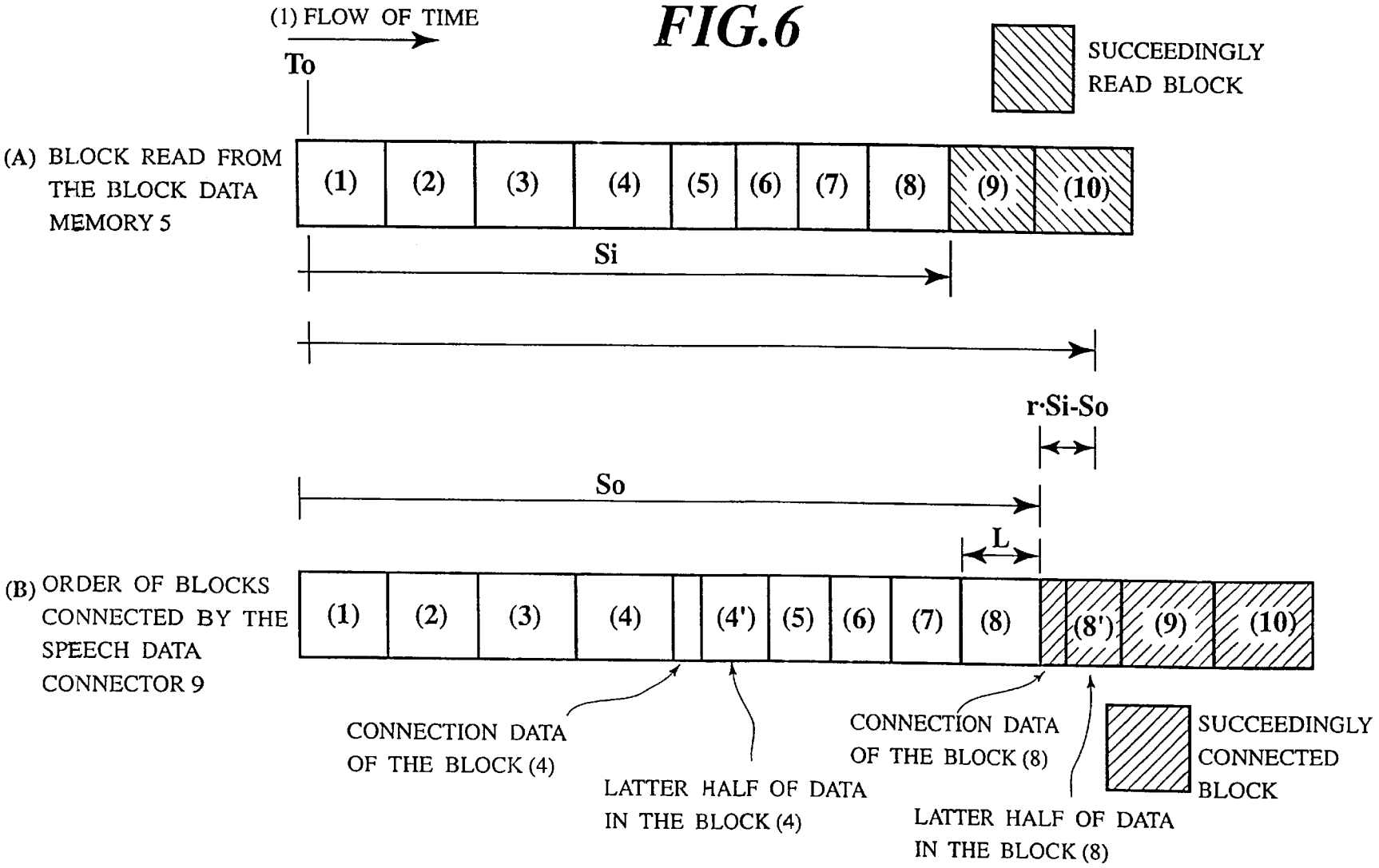
FIG. 6 is a schematic view showing an example of connection order which is generated by the connection order generator shown in FIG. 1.

Then, as shown in FIG. 5, a target length which is generated by an I/O data length monitor/comparator 20 provided in the connection order generator 8 is sent to the speech data connector 9 as connection order information. The I/O data length monitor/comparator 20 comprises an input data length monitor 21 for monitoring the input data length; an output target length calculator 22 for calculating a target length (target data length) of the output data generated by the speech speed factor conversion, which is effected based on the input data length obtained by the input data length monitor 21 and the value given by the listener (or a function memory built in the device), for example, and also correcting this target data length automatically; a comparator 23 for comparing the target data length obtained by the output target length calculator 22 with the input data length obtained by the input data length monitor 21, and then setting the target data length to coincide with the input data length if the target data length is shorter than the input data length, but outputting the target data length as it is if the target data length is longer than the input data length; an output data length monitor 24 for receiving ready-connected information concerning the output data supplied from the speech data connector 9 to monitor the output data length; and a comparator 25 for comparing the output data length obtained by the output data length monitor 24 with the target data length obtained by the comparator 23, and then setting the target data length to coincide with the output data length if the target data length is shorter than the output data length, but outputting the target data length as it is if the target data length is longer than the output data length. Then, as described later, the I/O data length monitor/comparator 20 reads out values being set in the memory for every attribute of the speech at a predetermined time interval, then calculates the target data length in order to attain extension factors for every read attribute, then generates the connection information, into which the scaling information of the speech are added, at every moment based on the target data length and the output data length obtained by the output data length monitor 24, and then connects the speech data and the connection data for every block, as shown in FIG. 6.

First, the input data length and the target data length are compared sequentially with each other, and then the target data length is corrected to coincide with the input data length if it has been decided that the input data length is longer than the target data length, but change of the target data length is suspended if it has been decided that the input data length is less than the target data length.

Then, the target data length and the actual output data length are compared sequentially with each other, and then the target data length is corrected to coincide with the output data length if it has been decided that the output data length is longer than the target data length, but change of the target data length is suspended if it has been decided that the output data length is less than the target data length.

Connection instructions indicating the extension information, connection information, etc. are generated to coincide with the target data lengths obtained by these comparing processes, and then supplied to the speech data connector 9.

Then, controlling conditions for the speech speed conversion factor in the connection order generator 8 will be explained hereunder. For example, in case the speech speed conversion is desired in the limited time range such as the time frame in the broadcast, the input data length and the output data length are monitored sequentially so as to measure time difference between both data at a time interval being previously set arbitrarily, and then such a function for changing the scaling factor adaptively may be set that the speech speed conversion factor is increased temporarily if an amount of delay is small but the speech speed conversion factor is decreased temporarily if an amount of delay is large.

For example, in this embodiment, assume that a start time of the first voiced sound appearing after a time when the non-speech interval of more than 200 ms appears is set to "t=0",and then a cosine function given by a following Eq.3 may be employed as a function which can provide a factor corresponding to the start time of the voiced sounds appearing in the range of "$0 \leqq t \leqq T$".

$$f(t)=rs+0.5(rs-re)(\cos \pi t/T+1.0) \quad (3)$$

Where t: $0 \leqq t \leqq T$ rs: an external input value by the listener ($1.0 \leqq rs \leqq 1.6$)

re: a value given as an initial value (e.g., re=1.0)

Then, the time difference between the input data length and the output data length is calculated at a certain constant time interval, e.g., every one second, and then the process is executed such that the initial value re is increased from "1.0" by "0.05" and conversely is decreased to about "0.95" according to the time difference at that time. However, in case the non-speech interval of more than 200 ms has not appeared yet at a point of time in excess of the time period T, a factor of 1.0, for example, is applied to the succeeding voiced sound interval. In this case, a new factor may be given by using a variable such as the pitch, the power, etc. as an index.

Further, a remaining rate of the non-speech interval may be changed adaptively in view of the speech speed conversion factor, the extension amount, etc. This may be set arbitrarily as a function.

Then, a compression allowable limit (a value indicating how long at least interval must be saved without reduction) of the non-speech interval is set to correspond to the external input value rs. This limit may be expressed by the above function, but it may be set discretely, for example, as described in the following.

At rs=1.0, this limit is reducible up to 300 ms
At rs=1.1, this limit is reducible up to 250 ms
At rs=1.2, this limit is reducible up to 230 ms
At rs=1.3, this limit is reducible up to 200 ms
At rs=1.4, this limit is reducible up to 200 ms
At rs=1.5, this limit is reducible up to 150 ms
At rs=1.6, this limit is reducible up to 100 ms In addition, a reduction system of the non-speech interval can be implemented by shifting a pointer to any address on the ring buffer. In this embodiment, omission of the speech information can be prevented by shifting the pointer to the start portion of the voiced sound immediately after the concerned non-speech interval.

Furthermore, the speech data connector 9 reads the speech data from the block data memory 5 in unit of block in compliance with the connection order decided by the connection order generator 8, then extends the speech data of the designated block, then connects the speech data and the connection data while reading out the connection data from the connection data memory 7 and suppressing the connection process not to cause excess and deficiency in capacity of the FIFO memory provided in the D/A converter 10, and then generates the output speech data to supply them to the D/A converter 10.

The D/A converter 10 D/A-converts the output speech data at a predetermined sampling rate (e.g., 32 kHz) while buffering the output speech data supplied from the speech data connector 9 by virtue of the FIFO memory, then generates the output speech signal, and then outputs it from the terminal 11.

In this manner, in this embodiment, when the speech-speed converted speech data are synthesized by applying an analyzing process to input speech data from a speaker based on attributes of the speech data and then using a desired function according to the analyzed information, the speech speed converting device can eliminate omission of the speech information against change in extension/scaling factors since these processes can be executed without inconsistency while comparing the input data length, the target data length calculated by multiplying the input data length by any scaling factor, and the actual output speech data length. And, the speech speed converting device can eliminate adaptively the time difference between the original speech and the converted speech because of the speech speed conversion by monitoring the time difference which varies at every moment and changing the scaling factor adaptively, e.g., by increasing the speech speed conversion factor temporarily when the time difference is small and conversely decreasing the speech speed conversion factor temporarily when the time difference is large, and further changing a remaining rate of the non-speech interval adaptively based on the speech speed conversion factor, an amount of expansion, etc. Therefore, the speech speed conversion factor and the non-speech interval can be controlled adaptively according to set conditions only by setting the conversion factor employed as the several-stage aims once by the user, and thus an expected effect for the speech speed conversion can be achieved stably within the time range being delivered actually.

As a result, the most suitable speech speed converting effect for respective speakers can be provided automatically to the broadcast program in which the speakers are changed frequently, etc. In addition, the present invention makes it possible for the aged person and the visually or acoustically handicapped person, who are difficult to listen the rapid talking, to listen the emergency news, which needs real time property, and the speech in the visual media such as the television stably and slowly without delay in time by an extremely simple operation.

Industrial Applicability

As described above, according to the speech speed converting method and the device for embodying the same of the present invention, the speech speed conversion factor and the non-speech interval can be controlled adaptively according to set conditions only by setting the conversion factor employed as the several-stage aims once by the user, and therefore the expected effect for the speech speed conversion can be achieved stably within the time range being delivered actually.

Also, according to the speech interval detecting method and the device for embodying the same of the present invention, the speech interval and the non-speech interval can be discriminated by executing the speech processing in real time so as to respond sequentially to change in the respective levels of the input speech and the background sound, while shortening the calculation time and also reducing the cost, since only the power which can be derived relatively simply as a feature parameter is employed.

What is claimed is:

1. A speech interval detecting method comprising the steps of:

calculating a frame power of an input signal data in unit of predetermined frame width at a predetermined time interval, and then holding a maximum value and a minimum value of the frame power within a past predetermined time period;

deciding a threshold value for power changed according to the maximum value being held and difference between the maximum value and the minimum value; and comparing the threshold value with power of a current frame to decide whether or not the current frame belongs to a speech interval or a non-speech interval.

2. A speech interval detecting method set forth in claim 1, wherein, if the difference between the maximum value and the minimum value is less than a predetermined value, the threshold value is decided close to the maximum value rather than a case where the difference between the maximum value and the minimum value is more than the predetermined value.

3. A speech interval detecting device comprising:

a power calculator (32) for calculating a frame power of an input signal data in unit of predetermined frame width at a predetermined time interval;

an instantaneous power maximum value latch (33) for holding a maximum value of the frame power within a past predetermined time period;

an instantaneous power minimum value latch (34) for holding a minimum value of the frame power within the past predetermined time period;

a power threshold value decision portion (35) for deciding a threshold value for power changed according to the maximum value being held in the instantaneous power maximum value latch and difference between the maximum value and the minimum value being held in the instantaneous power minimum value latch; and a discriminator (36) for comparing the threshold value obtained by the power threshold value decision portion with power of a current frame to decide whether or not the current frame belongs to a speech interval or a non-speech interval.

4. A speech interval detecting device set forth in claim 3, wherein, if the difference between the maximum value and the minimum value is less than a predetermined value, the power threshold value decision portion (35) decides the threshold value close to the maximum value rather than a case where the difference between the maximum value and the minimum value is more than the predetermined value.

* * * * *

UNITED STATES PATENT AND TRADEMARK OFFICE

CERTIFICATE OF CORRECTION

PATENT NO. : 6,374,213 B2 
DATED : April 16, 2002
INVENTOR(S) : Atsushi Imai, Nobumasa Seiyama and Tohru Takagi It is certified that error appears in the above-identified patent and that said Letters Patent is hereby corrected as shown below:

Title page, Item [54] and Column 1, lines 1-4,
Delete the current title and insert -- SPEECH INTERVAL DETECTION USING MAXIMUM AND MINIMUM FRAME POWER VALUES FOR PREDETERMINED NUMBER OF PAST FRAMES --.

Signed and Sealed this

Fifth Day of November, 2002

*Attest:*

*Attesting Officer*

JAMES E. ROGAN
*Director of the United States Patent and Trademark Office*